United States Patent [19]

Miller et al.

[11] 4,296,920

[45] Oct. 27, 1981

[54] MOLTEN METAL TREATMENT

[75] Inventors: Kirk D. Miller, Rexdale; John B. Flood, Willowdale; George Dimou, Toronto; Frederick E. Kara, Islington; Richard W. Amos, Etobicoke, all of Canada

[73] Assignee: Canron Inc., Montreal, Canada

[21] Appl. No.: 114,726

[22] Filed: Jan. 23, 1980

Related U.S. Application Data

[62] Division of Ser. No. 806,094, Jun. 13, 1977, Pat. No. 4,199,353.

[30] Foreign Application Priority Data

Jan. 18, 1977 [CA] Canada ..... 269973

[51] Int. Cl.[3] ..... C21C 7/00

[52] U.S. Cl. ..... 266/216; 75/93 R; 75/130 R

[58] Field of Search ..... 266/216; 75/93 R, 129, 75/130 R

[56] References Cited

U.S. PATENT DOCUMENTS

| | | | |
|---|---|---|---|
| 2,781,260 | 2/1957 | Grandpierre | 75/130 R |
| 2,809,886 | 10/1957 | Klingbeil | 75/93 R |
| 2,869,857 | 1/1959 | Kopke | 75/130 R |
| 3,137,753 | 6/1964 | Feichtinger | 75/93 R |
| 3,666,449 | 1/1969 | Alt | 75/130 B |
| 3,724,829 | 4/1973 | Alt | 75/130 R |
| 3,991,988 | 11/1976 | Kawai | 266/216 |
| 4,214,899 | 7/1980 | Radzilowski | 75/129 |

FOREIGN PATENT DOCUMENTS

| | | | |
|---|---|---|---|
| 1410157 | 10/1975 | United Kingdom | 75/130 R |

OTHER PUBLICATIONS

E. Modl, "Comparing Processes for Making Ductile Iron," *Foundry* (Jul. 1970).

*Primary Examiner*—P. D. Rosenberg
*Attorney, Agent, or Firm*—Stevens, Davis, Miller & Mosher

[57] ABSTRACT

In treating cast iron with magnesium to produce nodular iron, a capsule of heat-resistant material, closed except for calibrated limited access passages, containing the magnesium, is plunged into a bath of molten metal in a tall vertical ladle while the latter is capped by a hood to contain the violent reaction resulting. An elevating mechanism lowers and raises the hood and capsule and plunges and withdraws the capsule while the hood caps the ladle. The mechanism includes a plunging rod carrying the capsule and means for maintaining the rod in a fixed radial position relative to its axis and for restraining it against the force of the reaction.

6 Claims, 8 Drawing Figures

MOLTEN METAL TREATMENT

This is a Division of application Ser. No. 806,094 filed June 13, 1977, now U.S. Pat. No. 4,199,353.

BACKGROUND OF THE INVENTION

1. Field of the Invention

This invention relates to a process for introducing volatile additives into a molten metal and more particularly to treating molten iron with magnesium to produce nodular iron.

The invention also relates to apparatus useful in this method.

2. Description of Prior Art

Because of the explosive reaction between pure magnesium and molten iron, most treatments to produce nodular iron have aimed at taming the reaction by using magnesium alloys or delaying contact of the molten iron with magnesium.

One commercial solution, aimed at using pure magnesium, has been to employ a special tiltable converter with a refractory-walled receptacle for magnesium built into one side of it. The magnesium is loaded into the chamber by a closable access port through the wall and refractory lining of the vessel. Passages from the chamber to the interior of the converter allow entrance of molten iron and escape of reaction products into the body of the molten iron. For charging the magnesium, the converter is tilted on its side, with the chamber above the level of the metal. To carry out the treatment, the vessel is tilted into the upright position, submerging the chamber. The position of the entry and escape openings are said to permit a controlled flow of metal into and through the chamber and to insure a quiet and efficient iron-magnesium reaction enabling high receoveries.

This method has the disadvantage that a special converter is required in which the refractory wall is interrupted by the loading port. Also, the converter has to be manipulated between the upright and the tilted position and back again during each loading cycle. And, access for cleaning the entrance and outlet openings is hampered by the magnesium chamber being part of the vessel.

SUMMARY OF THE INVENTION

The applicant has now developed a process of introducing magnesium into molten iron which avoids the disadvantages of the prior art methods and provides certain positive advantages.

According to this process a body of molten iron to be nodularized is provided in a vertically elongated melt-confining zone, normally open to the atmosphere. The melt-confining zone can be the confines of a ladle of standard type. A vertically movable reaction zone is provided, having limited entry and exit means, in which the magnesium is placed. This access means includes lower restricted passage means at the bottom of the reaction zone and preferably upper restricted passage means to the reaction zone spaced upwards from the lower passage means. Pure magnesium, in solid form, is provided in the reaction zone in an amount effective to treat the iron. The reaction zone is then positioned within the melt-confining zone above the molten metal and the top of the melt-confining zone covered. Then, while the melt-confining zone is stationary, the rection zone is plunged vertically and centrally to near the bottom of the molten iron. The surrounding iron flows into the reaction zone through the passage means into direct contact with the magnesium causing a violent iron-magnesium reaction. The vapor pressure generated in the reaction zone causes magnesium vapor to escape through the passage means into the molten iron at a rate governed by the size of the passage means. The molten iron continues to enter the reaction zone and the reaction products to escape until the reaction is completed. The violent reaction causes extreme turbulence within the melt-confining zone and the top covering prevents massive escape and limits slopping. Once the reaction is complete, the melt-confining zone is uncovered, the reaction zone removed from it and the treated iron removed from the ladle.

Preferably, the reaction zone is the chamber of a capsule having a wall of heat-resistant material with calibrated entry-exit ports of limited size. The capsule is connected to a plunging mechanism operated in conjunction with a vertically movable protective hood for capping the ladle.

Desirably, prior to a production run, as described above, a start-up procedure is carried out. This is effected by charging the capsule with a small amount of magnesium and fluxing agent and plunging it into the iron at operating temperature. A magnesium-iron reaction of limited magnitude takes place to heat the capsule to operating temperature. Then, it is ready for production runs.

The invention permits the relatively continuous production of nodular iron by moving a series of ladles containing molten iron under the plunging mechanism, one after the other. During the treating cycle, with the capsule in retracted position, following a previous treatment, the passages are cleaned and the additive charged. While this is taking place, the next ladle is brought beneath the plunging mechanism. The hood of the plunging mechanism is then lowered to cover the top of the ladle and, at the same time, the capsule is lowered into the ladle above the molten metal. The capsule is then plunged into the molten metal to bring about the metal-additive reaction. When the reaction is complete, the capsule is withdrawn from the molten metal and the capsule and hood lifted by the elevating mechanism. The ladle is removed and replaced by a new ladle, and, the cycle repeated.

The invention makes it possible to use pure magnesium as the additive, despite the violent reaction provoked. The heat-resistant capsule is preferably made of a non-metallic non-wetting material, desirably graphite. The capsule has a cylindrical side wall connected at the top to a non-metallic plunging rod and is closed at the bottom by a wall forming a continuation of the side wall and having an opening constituting the lower access passage and an inside surface or floor sloping towards the opening. The upper charging passage is an opening through the cylindrical side wall spaced from the top. A preferred mechanism includes means for adjusting and maintaining the plunging rod in a fixed radial position relative to its axis so that the charging opening is conveniently located for charging. Means is also provided for restraining the plunging rod against lateral movement from the force of the reaction.

In the case of treating cast iron with magnesium to produce nodular iron there are certain preferred parameters for the capsule. The volume of the chamber in the capsule should be at least 80 cubic inches per pound of magnesium charged. The height of the ladle should be at least three times its lateral dimension. The depth of the iron in the ladle should be at least 1½ times the lateral dimension of the ladle. The depth of the iron above the upper passage in the capsule should be at least 15 inches. The clearance between the walls of the capsule and the ladle should be at least 5 inches. The capsule should be spaced between 1 to 2½ inches from the bottom of the ladle. The total cross-section of the passages in the capsule should be within the range from 2 to 5 sq. inches with any single passage having a maximum cross-section of about 3 sq. inches.

A feature of the invention is the use in combination with the capsule of magnesium bars preferably loaded through a top charging port in the capsule wall. The bars fall down onto the sloping floor of the capsule to form a pile in which the spacing between the bars permits quick contact throughout by molten metal. It is desirable that the charging port be just large enough to take the bar so that it cannot enter if the port is blocked.

The production rate in treating cast iron with magnesium, according to the invention, may range up to as many as 40 plunges per hour, including the steps of filling the ladle with molten iron, lowering the ladle onto a buggy, moving the buggy to bring the ladle into treating position under the plunging mechanism, loading the capsule, inspecting and cleaning the capsule passages, if necessary, lowering the hood to the top of the ladle, plunging the capsule, retaining the capsule within the molten metal during the reaction, raising the capsule from the molten metal, raising the hood and capsule, and removing the ladle from treating position to be replaced by another.

A desired temperature range of the molten iron is from 2500° F. to 2750° F. with a preferred range from 2580° F. to 2600° F.

The apparatus for carrying out the process includes an elevating mechanism for the hood for capping the ladle and a related plunging mechanism for the capsule. The hood for capping the ladle and the capsule for the magnesium are connected to the elevating mechanism for separate up and down movement. The plunging rod extends through a central opening in the hood for movement relative to it by the elevating mechanism. The hood may be thus lowered into capping contact with the top of the ladle containing the molten iron and the capsule, at the same time lowered into the ladle above the molten metal and then the graphite rod may be lowered rapidly relative to the hood to plunge the capsule into the molten metal, and when the reaction is complete these movements may be reversed.

BRIEF DESCRIPTION OF THE DRAWING

Having thus generally described the invention, it will be referred to more particularly by reference to the accompanying drawings illustrating preferred embodiments and in which.

DESCRIPTION OF THE PREFERRED EMBODIMENTS

Figure 1:
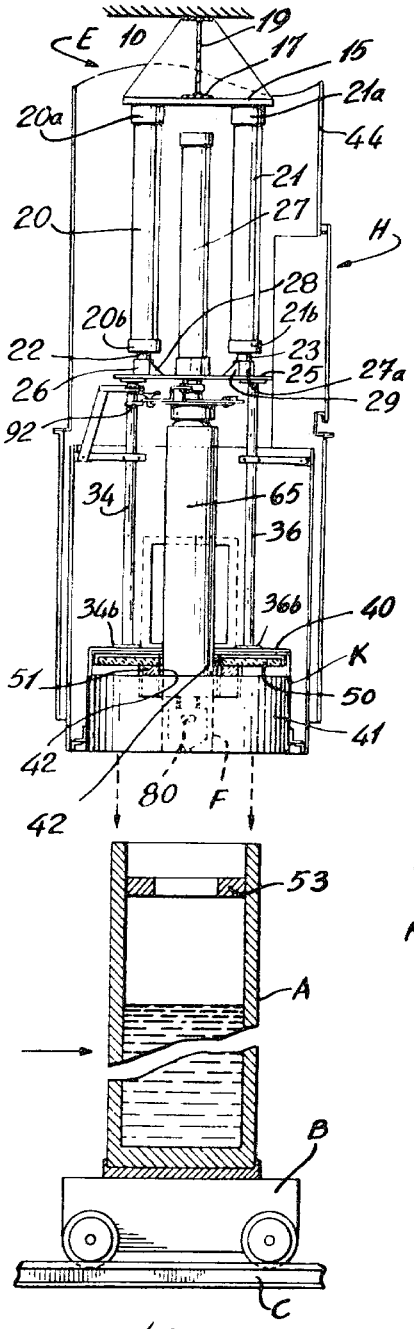
FIG. 1 is a side elevation partly in section of the plunging mechanism in position with the capsule and hood above a ladle containing iron about to be treated.
Figure 2:
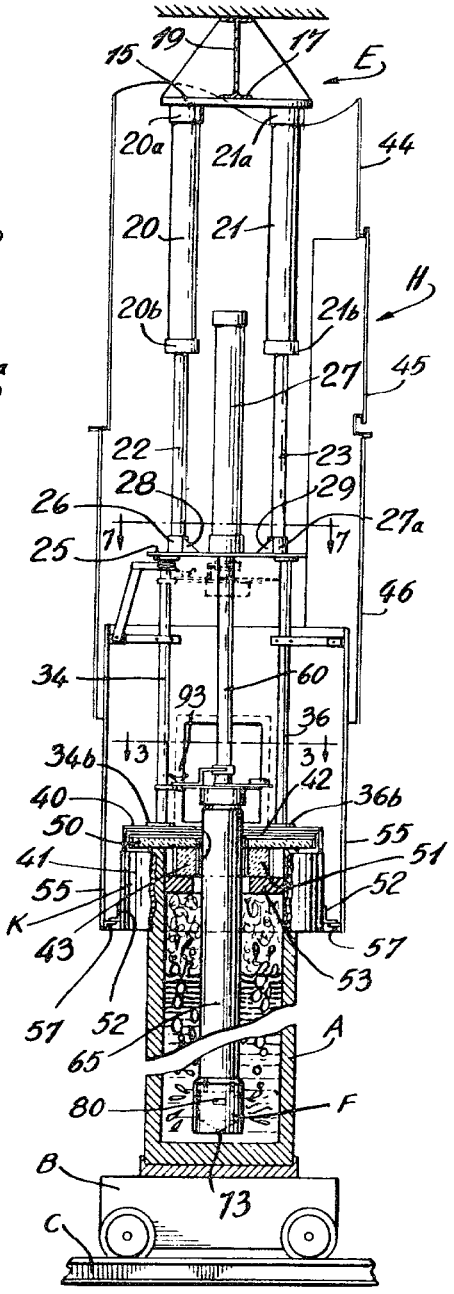
FIG. 2 is a similar view showing the plunging mechanism with the capsule and hood in the "treating" position.
Figure 3:
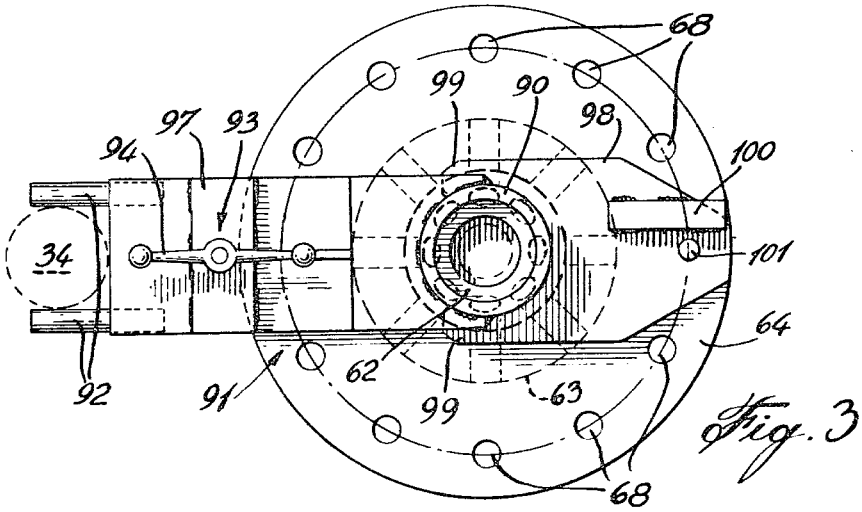
FIG. 3 is an enlarged fragmentary horizontal cross-section along the line 3—3 of FIG. 1.
Figure 4:
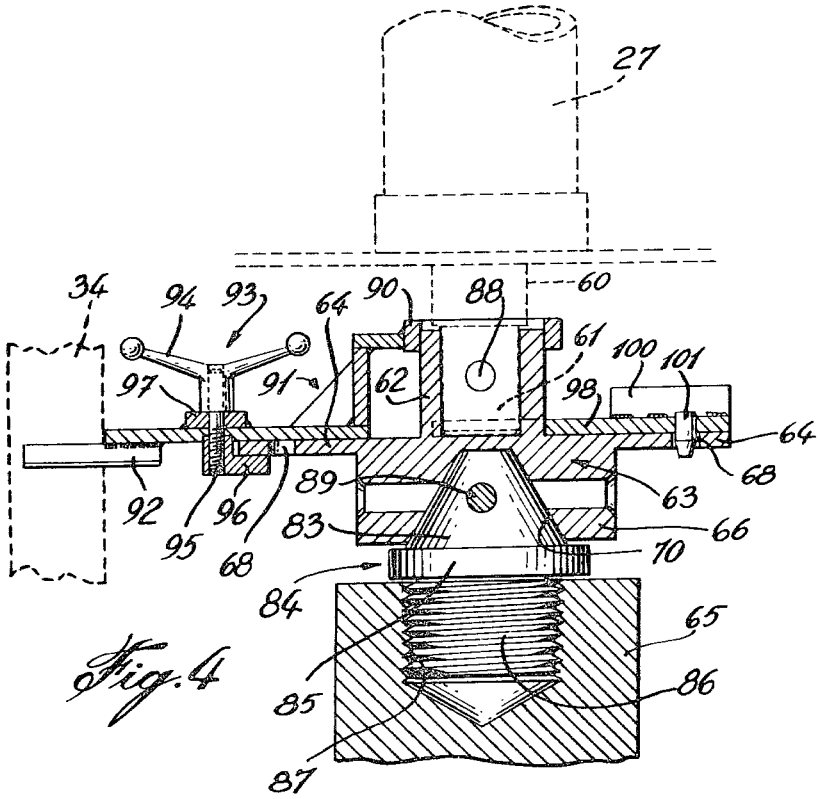
FIG. 4 is an enlarged detailed vertical cross-section partly in elevation through the parts connecting the capsule to the plunger-actuating rod and for locking it in position.
Figure 5:
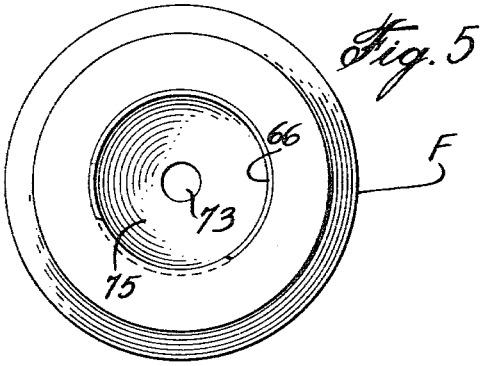
FIG. 5 is a top plan view of a preferred form of capsule.
Figure 7:
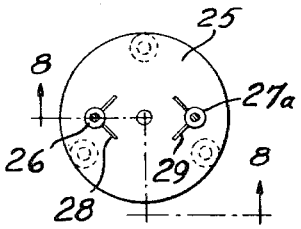
FIG. 7 is a cross-section along the line 7—7 of FIG. 1.
Figure 6:
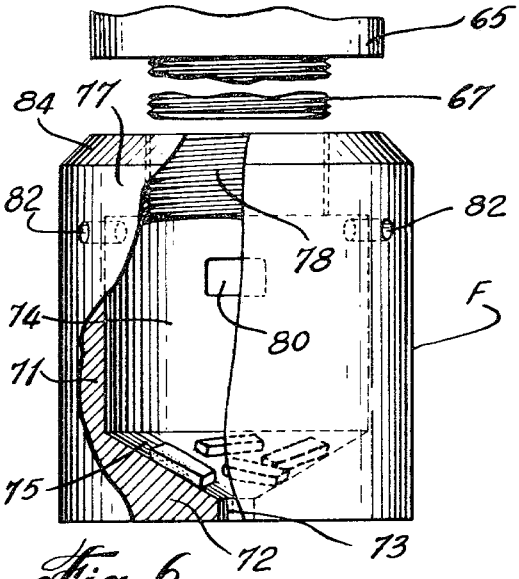
FIG. 6 is a side elevation partly in section, of the capsule of FIG. 5.
Figure 8:
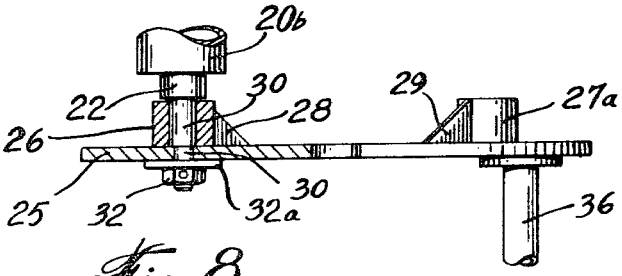
FIG. 8 is an enlarged detailed fragmentary side elevation partly in section showing the connection of one of the housing elevating rods to the cylinder support plate.

Referring more particularly to the drawings, a conventional treatment ladle A is shown carried by a conventional truck B movable along the plant floor C. Extending from a suspending beam D forming part of the building above an accessible treating position is a plunging mechanism E for a specially constructed heat-resistant capsule F for containing the magnesium and other additives. As will be explained later in more detail, the capsule F is designed with an upper loading port 80 for magnesium and a lower port 73 to allow entry of molten metal.

The plunging mechanism is equipped to move a capping hood K into and out of sealing contact with the top of the converter A so as to form a unit capable of withstanding the violent reaction of magnesium with molten metal. Then, the capsule with its charge of magnesium is quickly lowered into the metal to bring about the treating reaction, the capsule being maintained in position against the forces of the reaction by its relationship to other parts of the plunging mechanism.

The plunging mechanism E is constructed as follows. A mounting flange 15 is connected to the lower flange 17 of a channel member 19 connected to the beam D. Extending downward from each end of the flange 15 are parallel elongated twin hydraulic cylinders 20 and 21, with respective upper and lower collars 20*a*, 20*b*, 21*a* and 21*b*. Working in the cylinders 20 and 21 are rods 22 and 23. The bottom ends of the rods 22 and 23 are connected to a central cylinder support plate 25. This is accomplished by providing the ends of rods 22 and 23 with collars 26 and 27*a* welded to the plate 25. Triangular supports 28 and 29 extend between the collars 26 and 27*a* and the plate 25 and are welded thereto. Narrowed extensions 30 and 31 of the parts 22 and 23 extend through the plate 25 and are threaded to receive nuts 32 and 33 and washers 32*a* and 33*a*. Pistons (not shown) working within the cylinders 20 and 21 are operatively connected to the rods 22 and 23. And, a hydraulic system, controls and a timing system (not shown) are associated with the cylinders 20 and 21 so that the rods may be moved up and down hydraulically in timed relationship as required by the process. There are also connecting rods within the cylinders extending between the collars 20*a*, 20*b*, 21*a* and 21*b* to hold these parts together in a conventional manner.

Extending downwardly from the center of the plate 25 are support rods 34, 35 and 36. At their lower ends, the rods 34, 35 and 36 are connected by means of washers 34*b*, 35*b* and 36*b* welded to the top of a plate 40 forming part of an inner hood K. The hood K includes skirt 41 extending downwards from the outside edges of the plate 40. Underneath the plate 40 is a lining 50 of alumina refractory. The plate 40 and the lining 50 are provided with central openings 42 and 43 respectively. Extending downwardly from the lining 50 and having an inner surface 51*a* alinged with the openings 42 and 43 is an annular splash guard 51. A ring 53 of refractory material is connected to the inside of the ladle wall to engage the splash guard 51 when the hood K is in ladle capping position.

Connected to the bottom of the skirt 41 by an outwardly extending angle iron belt 52 mounted on the skirt 41 is a cylindrical outer hood 55 whose bottom is provided with a mounting ring 57 connected to the belt 52. An outer exhaust duct H surrounds the plunging mechanism. This duct is made up of parts 44, 45 and 46 connected together as shown and suspended from the building by means not shown.

Working in the central cylinder 27 is a rod 60 connected, as will be described, to a heavy cylindrical graphite rod 65. The rod 65 has a cylindrical lower tip 67 of reduced diameter, externally threaded to engage a tapped opening 66 in the top of the capsule F.

The rod 60 has a tip 61 of reduced diameter which fits into an upper socket 62 of an adjustable adapter 63. The adapter 63 is provided with an outwardly extending circular flange 64 and a downwardly extending boss 66. A bolt 88 extends through the socket 62 and the end 61 of the piston 60, holding these parts together. The flange 64 has a number of spaced apart openings 68. The boss 66 has an upwardly extending frusto-conical recess 70 which receives a frusto-conical head 83 of a connector 84. The connector 84 is provided with an outwardly threaded shank 86 which engages a tapped opening 87 in the top end of the rod 65. Bolts 89 extend through the boss 66 into the frusto-conical head 83 to secure the adapter 63 to the connector 84.

Surrounding the top of the socket 62 is a collar 90 connected to a goose-neck bracket 91 which extends outward and is connected to a forked member 92 which bears slidably against the rod 34.

Mounted on the bracket 91, intermediate the plate 64 and the member 92, is a locking mechanism. This locking mechanism is made up of a screw head 93 having manipulating handles 94 and a threaded shank 95 which extends through the bracket 91 to a threadable connection with an L-shaped detent 96. The detent 96 engages the underside of the plate 64 and urges it against the bracket 91 when the screw member 93 is turned in the one direction. A perforated washer-like bearing plate 97 is provided on which the head 93 bears.

The forked end 99 of an adjusting plate 98 surrounds the socket 62. The plate 98 is superimposed on the plate 64 and has a pipe 100 welded to its top side. A pin 101 is inserted through an opening in the plate 98 to engage in a selected opening in the plate 64.

The construction of a preferred capsule F is as follows. It is a hollow body having a wall of heat-resistant non-metallic non-wetting material, preferably graphite, enclosing a reaction chamber. There is passage means through the wall effective to allow entry of molten metal and the controlled escape of reaction products. It is desirable that there be as few openings as possible, preferably two, one upper and one lower. A preferred body is of overall cylindrical shape having a side wall 71 merging into a bottom wall 72 which tapers in thickness from the wall 71 to a central port 73. The top surface of the bottom wall 72 provides a sloping floor 75, preferably having a slope of at least 20% from the horizontal leading to a central downwardly facing port 73. The top periphery of the capsule F is provided with a tapered marginal surface 84.

At the top of the wall 71 there is an inwardly extending flange 77 constituting the top of the capsule F and providing a connecting collar having an internal tapped cylindrical surface 78 for threadable engagement with the tip 67 of the rod 65. Alternatively, if the rod tip 67 were of large enough diameter, the flange 77 could be eliminated and the inner side of the wall 71 provided with threads to engage the tip 67.

The wall 71 is provided, at a location somewhat below the flange 77, with a port 80 which serves both for charging magnesium and for escape of reaction products of magnesium and iron. Optionally, the wall 71 may be provided just underneath the flange 77 with vapor escape ports 82.

To connect the capsule F to the plunging mechanism E, the connector member 84 is attached to the adapter 63 which, in turn, is connected to the bottom of the rod 60. The rod 65 is screwed onto the connector 84 and the capsule F screwed onto the end of the rod 65.

To insure that the port 80 of the capsule F faces the right direction for ready access by the operator, adjustment is effected by turning the adapter 63, by exerting leverage on the plate 98 through the pipe 100. Once the capsule F is properly oriented, the adapter 63 is locked in position by clamping the plate 64 against the fixed bracket 91.

Process

Operating procedure is as follows. The capsule should be preheated before contact with the hot metal. This may conveniently be effected by placing it in a heated chamber. The heating should be electric since gas flame heating could burn the graphite. Overnight the rod and capsule should be kept in a heated container which maintains the capsule heated so as to prevent thermal shock when the capsule is plunged into the molten metal.

Prior to production run a start-up procedure is also desirable. This is effected by charging the capsule with one or two pellets of magnesium and some fluxing salt. The capsule is then plunged into the iron at operating temperature so that iron enters the ports 73 and 80. A magnesium-iron reaction of limited magnitude takes place to heat the capsule to operating temperature. The capsule is then ready for production heats.

The sequence of events in production heats is as follows. The operator loads the capsule F through the charging port 80 with the desired quantity of magnesium pellets. Preferably the magnesium pellets are in the form of bars S of a size and shape to be grasped individually by hand. A preferred bar S is elongated and, desirably, rectangular, although other shapes presenting an extensive surface area may be used. A preferred bar is flat sided, 3 to 4 inches long by about $\frac{7}{8}$ of an inch to about 1 inch in the other dimensions. Cylindrical bars of comparable volume may be employed. The shape thus provides a bar S having, in effect, a handle which can be grasped like a relay baton and pushed into the charging port 80 and then released and pushed into the port so that it drops into the chamber. When the pellets of the preferred bar shape are used, these are grasped by the operator or by a charging apparatus and pushed one-by-one through the charging port 80. A bar can only enter the opening 80 when the latter is unfouled, since the cross-section of the bar is only slightly less than the cross-section of the port 80 and any reaction product from a previous treatment which blocks the opening 80 would prevent entry. The bars S fall onto the sloping floor 75 and then on each other to be distributed randomly to form a pile with voids extending through it between the bars. The arrangement of the bars in combination with that of the floor 75 and opening 73 prevents them from falling out of the chamber 84.

Any additives are also added, for example, cerium up to about 3% by weight of the magnesium in the form of Misch-metall pellets and sodium chloride as a flux for the slag, up to about 8% by weight of the magnesium.

The ladle A is placed on the buggy C which is moved to treating position under the hood K. The hood K is lowered onto the treatment ladle by actuating the hydraulic mechanism to lower the rods 22 and 23 and the capsule descends with the hood to within the ladle in the space above the molten metal. The reaction capsule F is then plunged into the iron by hydraulically actuating the rod 60.

At first contact with the iron, the molten metal rushes into the bottom port 73 and through the pile of bars S and reacts with the magnesium and some of it is vaporized and ejected from the charging port 80. It is likely that during the first few seconds after immersion some iron also penetrates the port 80 and contacts the pile of bars S from the top to increase the force of the reaction. At this point the reaction develops with enough speed to generate enough pressure, within the reaction capsule F, to force reaction products from all openings. Violent turbulence is caused in the molten metal and agitation of the metal around and beneath the capsule. This effect probably lasts during most of the vaporization of the charged magnesium. As the internal pressure begins to subside, the iron preferentially enters the port 73 and exits from the port 80, thereby flushing out magnesium vapor or magnesium-iron mixtures left unreacted inside the reaction chamber. The reaction creates a vivid flare which escapes between the capsule F and the hood K. Any massive slopping of the metal from the ladle is prevented by the hood K. The total reaction from flare initiation to completion takes about thirty seconds. Once the flare subsides, the operator waits a few seconds and then raises the hood and rod assembly simultaneously.

While the ladle A remains beneath the capsule F, the port 73 serves as a drain hole which the operator inspects and, if necessary, cleans it and the port 80 to insure that they are unblocked. The operator then moves the ladle from under the plunging station where it is picked up and taken to production. Then another ladle is moved into treating position and the cycle repeated.

The production rate may run up to 40 plunges per hour with 30 to 40 being a reasonable range.

It will be understood that a hydraulic system and appropriate control means (not shown) are connected to the respective cylinders 20, 21 and 27 for raising and lowering in the appropriate time and approximate sequence the plate 25 and the rod 60, respectively, so that the hood and capsule may perform the necessary movements.

PREFERRED PROCESS AND APPARATUS PARAMETERS

The capsule F is made of heat-resistant non-metallic non-wetting material, preferably standard electrode quality graphite, preferably "Grade AGSR" as supplied by Union Carbide Company of Canada Ltd. Clay graphite is not recommended. The capsule is formed by machining from a molded block of graphite formed by pressing and baking according to known methods, as described in the "Industrial Graphite Engineering Handbook", distributed by Union Carbide Company of Canada Ltd., Metals & Carbon Division, Toronto, Canada, Copyright 1959. This text is hereby incorporated by reference.

Recommended parameters for a capsule constructed like the described capsule F above are as follows.

The interior volume of the reaction chamber 74 of the capsule F should not be less than 80 cubic inches per pound of pure magnesium charged. With the volume of the chamber 74 below that level, the iron entering it, at the beginning of the treatment, would not have the heat capacity to bring the contained magnesium to vaporization temperature. In practice, this would result in an iron-magnesium build-up in the chamber, preventing further use of the capsule.

The capsule illustrated in the drawings is 12 inches in diameter. The minimum thickness of the wall 71 is about 1 inch. This provides strength and, at the same time, a balance between the inside and outside diameters. Larger values reduce the interior volume for given outside diameter without much change in life expectancy.

A 10 inch capsule may also be used. In this case it has no tapered upper outer edge 84, and the outer wall would align with the rod 65, the opening 78 remaining the same size. Other sized capsules may be employed within the defined principles of the invention.

The total cross-sectional area of the openings in the wall of the capsule F communicating between the chamber 74 and the surrounding iron in the ladle A should fall between 2.0 and 5.0 sq. inches, with no single opening greater than 3.0 sq. inches in cross-sectional area. These values ensure that the mass flow rate (pounds of magnesium by escape velocity) will not be greater than the iron can efficiently absorb, so as to ensure, in turn, that the iron will be effectively treated with magnesium to produce a nodular iron. Any smaller opening area can cause iron-magnesium build-up. The openings must also be large enough to allow rapid filling of the chamber 74 with iron, as the capsule is plunged into it to prevent freezing of the iron, which would block the openings and interfere with vaporization. As large a charging port 80 as possible is desirable, since too small a one would require too many magnesium pellets to be charged to give the proper total amount of magnesium for the capacity of the chamber. The upper size of the port 80 is dictated by the recovery to be accomplished, the lower size by the practicality of inserting the magnesium. The placement of the port 80 is dictated partly by leaving enough space below it for inserting the proper number of pellets usually up to about fifteen.

The size of the bottom port 73 should be not less than 1.25 inches in diameter so as to allow the chamber 74 to drain rapidly and so as not to delay production or block the opening with lump-like reaction products. The maximum size is limited by the combination of other parameters as described above. The positioning of the opening 73 at the bottom of the capsule F locates it as low as possible in the melt and also enables it to serve as a drain for products of the reaction to leave the capsule when withdrawn from the melt, assisted by the sloping floor of the capsule.

Preferably, a minimum opening area of 1.5 sq. inches (which can either be the charging port 80 or the optional opening 82) is located within 2 inches of the top of the interior of the chamber 74, to allow magnesium vapor to escape and prevent build-up of unreacted magnesium and magnesium iron mixture to the point where it would inhibit and possibly stop the vaporization of magnesium too soon. Maximums are determined by other parameters described above. The calibre and placing of the openings minimizes the mass flow rate of magnesium vapor into the iron into which it is introduced in a controlled manner and through which it bubbles and creates turbulence. Preferably, the distance from the extreme bottom of the reaction chamber to the medium line of the charging port is at least about 10 inches.

The thickness of the bottom wall 72 should be, at its thickest, about 3 inches, and at its thinnest, about 1 inch. The angle of the floor 75 should be at least about 25% to the horizontal to provide an effective drainage slope for molten products remaining after the capsule is withdrawn from the molten metal to flow to the opening 73.

The depth of the iron, in the ladle, above the uppermost openings 82 or 80 in the capsule should be at least about 15 inches. Lower values result in reduction of efficiency in magnesium absorption into the iron. Similarly, the bottom of the capsule F should be between 1 inch to $2\frac{1}{2}$ inches from the bottom of the treatment ladle A to allow a circulation zone beneath the opening in the bottom of the capsule. A value below this range can result in blockage of the bottom port while a value above it is unnecessary and reduces the depth of metal above the uppermost ports in the capsule.

The difference between the inside diameter of the ladle A and the outside diameter of the capsule F should be at least 5 inches. A smaller difference could result in the capsule F striking the side of the ladle A during the reaction with possible damage to the capsule.

The height of the ladle A is a function of diameter and the amount of iron being treated, and generally is at least three times the inside diameter, providing that the depth of iron during the reaction is no greater than 1.5 times the ladle inside diameter. This height is required to avoid an excessive overspillage of iron due to the violence and turbulence generated during the reaction.

The temperature of the iron may run from 2500° F. to 2700° F. A preferred temperature range is from 2580° F. to 2600° F. Working at this high temperature is desirable from the point of view of treating the iron, but brings about mechanical problems. The violence of the reaction is hard on the apparatus. The present apparatus is designed to withstand the force of the reaction, first of all by the sturdiness of the magnesium-containing capsule F and then by the nature of the plunging apparatus. The capsule F is restrained from lateral movement while subjected to the reaction of the blast of magnesium vapor from the opening 80 by the restraint of the rod 65 from lateral movement by contact with the refractory lining 50 of the hood K.

In one practical apparatus, the diameter of the refractory-lined opening 42 is about 13 inches, and the outside diameter of the rod 65 about 10 inches. After a few plunges slag and metal builds up as an adherent coating on the surface of the rod 65. The thickness of this build-up is limited by the rod being withdrawn through the opening and the refractory scraping off excess while it is in a pasty molten state before it has had a chance to solidify. So, in operation, the rod has effectively a push fit in the opening 42.

With the prior art process using a modified ladle having a built-in magnesium pocket, it is recommended that there be at least five treatments per hour. Otherwise, the ladle must be kept artificially heated to avoid solidification of deposits in the openings. If this is not done, with magnesium loaded into the ladle from the outside and the outlet openings in the magnesium chamber plugged, there can be enough heat to vaporize the magnesium prematurely and inadvertently and cause a pressure build-up resulting ultimately in an explosion.

In the applicant's case shut-downs of as much as an hour are possible, without adding external heat to the capsule of the rod, before it is again used in the plunging treatment. Because standard magnesium pellets are used the capsule F cannot be charged until the port 80 has been reamed free of foreign material. A further safeguard is that in the event of reaction the metal would be prevented from being projected upwards by the hood K which would direct any slopping downwards.

EXAMPLE

The following is a typical procedure according to the invention in apparatus as described above keyed to the reference numerals employed.

A standard ladle A was charged from a holding furnace at 2580° F. (1415° C.) with a cast iron heat of the following chemical composition:

3.55% C
2.55% Si
0.50% Mn
0.015% P
0.040% S

The amount of iron poured into the ladle was 2300 lbs. (1045 kg.). Pure magnesium in the form of bars $1\frac{3}{4}$ by 1 inch having a length of $3\frac{1}{2}$ inches, each bar weighing 0.44 lbs. (200 grams) was charged through the opening 80 into the capsule of the following characteristics and dimensions described above to provide an addition of 0.21% by weight of magnesium to iron.

The preferred capsule was 13 inches in height from the outside of the bottom wall to the outside top of the flange 77. The flange was $2\frac{3}{4}$ inches in thickness. The medium line of the opening 80 was $4\frac{3}{4}$ inches below the top surface of the flange 77. The overall outside diameter of the capsule was 12 inches and the inside diameter 9 inches. The thickness of the bottom wall 75, at its connection with the side wall, was 3 inches and its thickness adjacent the port 73 was 1 inch. In this preferred form the port 73 was $1\frac{1}{4}$ inches in diameter and the port 80, $1\frac{1}{4}$ inches high by 2 inches in width. The ports 83 were set with their centers $3\frac{1}{4}$ inches below the top of the flange 77 and were $\frac{3}{4}$ of an inch in diameter. The top of the wall 71 had a 45° bevel 1 inch below the top surface of the flange 77. The threaded top opening defined by the flange 77 was 5 inches in diameter.

The ladle A was lowered onto a buggy B. This took about 10 seconds. The buggy B was moved under the hood K. This took about 15 seconds. Meanwhile, the capsule F was loaded with magnesium pellets which took about 8 seconds. The hood K was lowered to cap the top of the ladle A. This required about 5 seconds.

Then, the capsule F was plunged in about 5 seconds to within about 2 inches of the bottom of the ladle A. Iron immediately flowed into the capsule F and provoked an immediate iron-magnesium reaction causing a visible flare emanating from between the hood K and the ladle A. The flare lasted for about 30 seconds, whereupon the capsule F was retracted by the plunging mechanism in about 5 seconds to above the molten iron. Then, the hood K and the capsule were further retracted in about 5 seconds.

The ladle A was then removed on the buggy B and replaced by another ladle in position for a further heat.

Contents of the ladle containing the treated metal were poured into another ladle where a sample was taken indicating a chemical composition containing:

0.007% S 0.032% Mg

This gives a magnesium yield $$\left(\% \text{ magnesium recovery} = \frac{0.75\ \Delta\ S\ \% + \%\ \text{magnesium residual}}{\%\ \text{magnesium addition}} \times 100\right) \text{ of } 27.2\%.$$

The resulting iron provided a microstructure consisting of 90% or better ASTM Type I and II graphite nodules.

A series of heats were treated as above at about 35 plunges of the capsule F into the molten metal per hour.

We claim:

1. An apparatus for treating molten metal at atmospheric pressure with a volatile additive producing a violent reaction when contacted by the molten metal, for use with a vertically elongated single walled treating ladle having a cylindrical inner wall and floor defining a treating chamber and having a top opening surrounded by an annular rim, comprising, a vertically movable inner hood having a circular base for seating on said rim to contain the escape of molten metal but to allow the escape of gases therefrom during the reaction and provided with a central opening, a vertically movable open-topped outer hood outwardly spaced from and surrounding and extending upwardly from the inner hood and connected to the lower part of it to intercept slopped molten products and to conduct gases escaping from the ladle, a stationary exhaust duct outwardly spaced from and surrounding the outer hood and extending upward therefrom to receive from it gases escaping from the ladle, a vertically movable support member spaced above the inner hood and connected thereto whereby, when the support member is raised and lowered, the inner and outer hoods are raised and lowered with it, a stocky plunging rod of solid heat-resistant non-metallic non-wetting material non-consumable in the reaction of a cross sectional size slightly less than that of said opening in the inner hood and extending therethrough, an overall cylindrical self-contained capsule removably mounted on the lower end of the plunging rod and having an integral floor and sidewall of heat-resistant non-metallic non-wetting material non-consumable in the reaction defining an addition-receiving chamber, the sidewall extending upward from the bottom wall to an open top surrounded by a terminal collar part connectably received by the end of the solid plunging rod to close the open top, said sidewall being provided with a restricted access passage sized to receive individual solid shaped pieces of additive and to permit controlled ingress of molten metal and controlled escape of reaction products, the bottom wall being provided with a central restricted passage sized to bar escape of said solid shaped pieces and to permit controlled ingress of molten metal and controlled escape of reaction products, the inner hood having a cover assembly including a refractory lined cover to overlie the opening of and engage the rim of the ladle and an adjoining skirt for surrounding the top margin of the side of the ladle, the cover assembly including downwardly extending means for engaging the wall of the ladle, the cover assembly having a central opening defining a passage for the plunging rod limiting its sideways movement against the force of the reaction, means for raising and lowering said support member to cap and uncap the ladle and for moving the capsule into ready position above the molten metal and for withdrawing it therefrom, a cylinder on said support member and a piston rod extending downward therefrom to a connection with said plunging rod for raising and lowering it independently of the hood for plunging the capsule into the molten metal from ready position and withdrawing it thereto.

2. An apparatus, as defined in claim 1, including, a mounting device for a plunging rod of the type described, comprising, an adapter having a base plate provided with a socket for receiving the end of an elevating rod extending upwards therefrom, a boss extending downwards from said plate and having a recess for receiving a connector from the rod, a bracket slidably seated on the base plate and having a fixed connection to the adapter, and means for clamping the plate and bracket together to prevent their relative movement.

3. A mounting device, as defined in claim 2, wherein, a mounting bolt has a head locked into said recess and a threaded shank extends downwardly from the head for engagement with the top of said elevating rod.

4. An apparatus, as defined in claim 1, in which the rod is a stocky rod made of graphite and the container is a capsule of graphite.

5. An apparatus, as defined in claim 4, in which the capsule has a tapped top opening and the plunging rod has a bottom threaded end engaging in said opening.

6. An apparatus, as defined in claim 1, in which the downwardly extending means on the cover assembly includes an annular splash guard and a ring extending outwardly therefrom for engaging the wall of the ladle.

* * * * *